US011198834B2

(12) United States Patent
Sekiguchi et al.

(10) Patent No.: US 11,198,834 B2
(45) Date of Patent: Dec. 14, 2021

(54) GREASE COMPOSITION

(71) Applicant: IDEMITSU KOSAN CO., LTD., Chiyoda-ku (JP)

(72) Inventors: Hiroki Sekiguchi, Ichihara (JP); Go Watanabe, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/609,308

(22) PCT Filed: Apr. 27, 2018

(86) PCT No.: PCT/JP2018/017342
§ 371 (c)(1),
(2) Date: Oct. 29, 2019

(87) PCT Pub. No.: WO2018/203543
PCT Pub. Date: Nov. 8, 2018

(65) Prior Publication Data

US 2020/0048574 A1 Feb. 13, 2020

(30) Foreign Application Priority Data

May 1, 2017 (JP) ..... JP2017-091403

(51) Int. Cl.

| | |
|---|---|
| ***C10M 169/02*** | (2006.01) |
| ***C10N 20/02*** | (2006.01) |
| ***C10N 40/02*** | (2006.01) |
| ***C10N 50/10*** | (2006.01) |
| ***C10N 40/06*** | (2006.01) |

(52) U.S. Cl.
CPC .... *C10M 169/02* (2013.01); *C10M 2203/065* (2013.01); *C10M 2215/006* (2013.01); *C10M 2215/1026* (2013.01); *C10N 2020/02* (2013.01); *C10N 2040/02* (2013.01); *C10N 2040/06* (2013.01); *C10N 2050/10* (2013.01)

(58) Field of Classification Search
CPC ..... C10M 169/02; C10M 2203/06; C10M 2203/065; C10M 2215/1026; C10N 2050/10; C10N 2250/10; C10N 2020/02; C10N 2030/30; C10N 2030/62; C10N 2040/02; C10N 2040/06
See application file for complete search history.

(56) References Cited

U.S. PATENT DOCUMENTS

| | | | | |
|---|---|---|---|---|
| 3,598,734 | A | 8/1971 | Borg, et al. | |
| 2010/0305012 | A1* | 12/2010 | Miyamoto | C10M 169/02 508/555 |
| 2011/0041638 | A1* | 2/2011 | Fujinami | C10M 169/02 74/424.81 |
| 2014/0045733 | A1* | 2/2014 | Nogami | C10M 141/12 508/100 |
| 2015/0024981 | A1* | 1/2015 | Ayame | C10M 169/00 508/155 |
| 2015/0045272 | A1* | 2/2015 | Fujimaki | C10M 141/06 508/503 |
| 2017/0327760 | A1* | 11/2017 | Egersdorfer | C10M 169/044 |

FOREIGN PATENT DOCUMENTS

| | | | | | |
|---|---|---|---|---|---|
| CN | 101405375 | | | 4/2009 | |
| CN | 104169404 | | | 11/2014 | |
| CN | 105008738 | | | 10/2015 | |
| CN | 105273799 | | | 1/2016 | |
| CN | 106103675 | | | 11/2016 | |
| CN | 107955677 | A | | 4/2018 | |
| DE | 10 2014 018 718 | A1 | | 6/2016 | |
| JP | 52-156274 | | | 12/1977 | |
| JP | 11-166191 | A | | 6/1999 | |
| JP | 11166191 | A | * | 6/1999 | C10M 169/06 |
| JP | 2004-352953 | A | | 12/2004 | |
| JP | 2005-132900 | A | | 5/2005 | |
| JP | 2013-18861 | A | | 1/2013 | |
| JP | 2013-129794 | A | | 7/2013 | |
| JP | 2013-181156 | A | | 9/2013 | |
| JP | WO 2018/043744 | A1 | | 3/2018 | |
| RU | 2 086 611 | C1 | | 8/1997 | |
| WO | WO-2016096074 | A2 | * | 6/2016 | C10M 105/36 |

OTHER PUBLICATIONS

International Search Report dated Jul. 17, 2018 in PCT/JP2018/017342 filed on Apr. 27, 2018.
Extended European Search Report dated Dec. 21, 2020 in European Patent Application No. 18793857.6, 7 pages.
Japanese Office Action dated Jan. 19, 2021 in Japanese Patent Application No. 2017-091403 (with English translation), 5 pages.
Office Action in IN Application No. 201947044085, dated Mar. 31, 2021 (with English translation).
Office Action in CN Application No. 201880028544.5, dated Aug. 27, 2021.
Yao Lidan et al., "Effects of a thickening agent component and the refining temperature on the structure and properties of urea-based grease", The National Grease Technology Exchange Conference, pp. 67-70, Chinese Petroleum Society., Oct. 1, 2001; Sponsor: Chinese Petroleum Society; Editor: Editorial Office of Grease Technology Exchange Conference Publisher: China Petrochemical Press Co., Ltd.

(Continued)

*Primary Examiner* — James C Goloboy
(74) *Attorney, Agent, or Firm* — Oblon, McClelland, Maier & Neustadt, L.L.P.

(57) ABSTRACT

Provided is a grease composition including a base oil (A) containing an alkyl naphthalene (A1) and an aliphatic diurea (B) represented by general formula (b1):

$$R^1\text{—NHCONH—}R^3\text{—NHCONH—}R^2 \quad \text{(b1)}$$

(wherein, $R^1$ and $R^2$ each independently represent a monovalent aliphatic hydrocarbon group having 9 to 20 carbon atoms, and $R^3$ represents a divalent aromatic hydrocarbon group having 6 to 18 carbon atoms), wherein a content of the aliphatic diurea (B) is 20 to 30% by mass based on a total amount of the grease composition.

6 Claims, No Drawings

(56) References Cited

OTHER PUBLICATIONS

Li Li et al., "influences of Diurea-based Grease Composition on Performance of High Temperature Hardening", Petroleum Products Application Research, vol. 31:5, p. 34-41., Oct. 31, 2013. Sponsor: Lubricating oil R&D Center (Shanghai), SINOPEC, Editor &Publisher: Editorial Office of Petroleum Products Application Research: Distributor(Domestic): Shanghai Post Office.

* cited by examiner

GREASE COMPOSITION

TECHNICAL FIELD

The present invention relates to a grease composition.

BACKGROUND ART

In general, a precision electronic device manufacturing apparatus such as a semiconductor manufacturing apparatus, a liquid crystal manufacturing apparatus, and a printed circuit board manufacturing apparatus is required to be used in a clean environment with very little dust, and is typically installed in a clean room. Examples of the driving part of such an apparatus include a ball screw, a linear guide, a servo motor, and the like. Further, even in a food production factory, a pharmaceutical manufacturing factory, and the like, a clean environment is required in order to prevent foreign matters from being incorporated into products.

Apparatuses or equipment used in such a clean environment have or has bearings, sliding portions, joint portions, and the like. Moreover, in the portions to be lubricated, a grease with reduced oil scattering, that is, a low-dusting grease is used.

As such a low-dusting grease, a fluorine-based grease has been used in the related art.

However, the fluorine-based grease is generally expensive, and furthermore, it is difficult to say that the fluorine-based grease has a sufficient low dust generation property. In addition, the fluorine-based grease has insufficient lubrication performance compared to other greases, and in the lubricated portions filled with the fluorine-based grease, torque loss due to friction or stirring may increase in some cases. Furthermore, in the manufacture of precision electronic parts such as semiconductor apparatuses, the incorporation of halogen components into products adversely affects the product yield.

Therefore, a non-halogen-based low-dusting grease composition using a lithium-based soap as a thickening agent has also been proposed. For example, PTL 1 discloses a grease composition containing 15 to 30% by mass of a fibrous thickening agent having a predetermined length and diameter in a base oil having a predetermined kinematic viscosity. The thickening agent is a lithium salt of a fatty acid having 10 or more carbon atoms and having no hydroxy group.

However, the grease composition described in PTL 1 has an insufficient low dust generation property.

Further, since the grease composition described in PTL 1 contains a metal salt as a thickening agent, when the grease composition is scattered, malfunction caused by adhesion to a precision electronic apparatus such as a semiconductor apparatus is likely to occur.

In view of the aforementioned problems, a non-halogen-based low-dusting grease composition using a urea-based thickening agent has also been proposed. For example, PTL 2 discloses a grease composition containing a base oil in which at least one selected from synthetic hydrocarbon oil and ether oil is blended, and a thickening agent composed of a urea compound.

CITATION LIST

Patent Literature

PTL 1: JP 2004-352953 A
PTL 2: JP 11-166191 A

SUMMARY OF INVENTION

Technical Problem

In the grease composition disclosed in PTL 2, the amount of dust generated is suppressed by adjusting the worked penetration to a range of 190 to 230 to harden the grease composition.

However, the grease composition described in PTL 2 has insufficient low dust generation property. Thus, the low dust generation property is not necessarily sufficient even though the grease composition is made hard by lowering the worked penetration of the grease composition.

The present invention has been made to solve the aforementioned problems, and an object thereof is to provide a grease composition having an excellent low dust generation property at a level applicable to the portions to be lubricated such as bearings, sliding portions, and joint portions of an apparatus to be used in a clean environment such as a clean room where dust generation is extremely low.

Solution to Problem

The present inventors have found that the aforementioned problems can be solved by a grease composition including, together with a base oil containing an alkyl naphthalene, a predetermined amount of a specific aliphatic diurea, thereby completing the present invention.

That is, the present invention relates to the following [1].

[1] A grease composition including a base oil (A) containing an alkyl naphthalene (A1), and an aliphatic diurea (B) represented by general formula (b1):

$$R^1—NHCONH—R^3—NHCONH—R^2 \quad (b1)$$

(wherein, $R^1$ and $R^2$ each independently represent a monovalent aliphatic hydrocarbon group having 9 to 20 carbon atoms, and $R^3$ represents a divalent aromatic hydrocarbon group having 6 to 18 carbon atoms), wherein a content of the aliphatic diurea (B) is from 20 to 30% by mass based on a total amount of the grease composition.

Advantageous Effects of Invention

The grease composition of the present invention has an excellent low dust generation property at a level applicable to the portions to be lubricated such as bearings, sliding portions, and joint portions of an apparatus that is used in a clean environment such as a clean room where dust generation is extremely low.

DESCRIPTION OF EMBODIMENTS

[Embodiment of Grease of the Present Invention]

A grease composition of the present invention is a grease composition including a base oil (A) containing an alkyl naphthalene (A1), and an aliphatic diurea (B) represented by general formula (b1)

$$R^1—NHCONH—R^3—NHCONH—R^2 \quad (b1)$$

(wherein, $R^1$ and $R^2$ each independently represent a monovalent aliphatic hydrocarbon group having 9 to 20 carbon atoms, and $R^3$ represents a divalent aromatic hydrocarbon group having 6 to 18 carbon atoms), wherein a content of the aliphatic diurea (B) is 20 to 30% by mass based on a total amount of the grease composition.

In general, it is said that a grease composition tends to be more improved in the low dust generation property as the grease composition is made harder by lowering the worked penetration of the grease composition. However, even if the grease composition is made hard by lowering the worked penetration, the grease composition does not necessarily have a sufficient low dust generation property.

Accordingly, the present inventors have intensively studied the improvement of low dust generation property in the grease composition from a viewpoint completely different from the viewpoint of the worked penetration or the hardness of the grease. As a result, the present inventors have found that a grease composition including, together with a base oil (A) containing an alkyl naphthalene (A1), 20 to 30% by mass of the aliphatic diurea (B) represented by general formula (b1), has an excellent low dust generation property.

The grease composition of an embodiment of the present invention may contain a general-purpose additive being used for grease, besides the above-described component (B), as long as the effects of the present invention are not impaired.

With respect to the grease composition of an embodiment of the present invention, a total content of the above-described components (A) and (B) is preferably 70 to 100% by mass, more preferably 75 to 100% by mass, still more preferably 80 to 100% by mass, yet still more preferably 85 to 100% by mass, and even yet still more preferably 90 to 100% by mass based on the total amount (100% by mass) of the grease composition.

Further, with respect to the grease composition of an embodiment of the present invention, when a metal atom-containing compound is used in preparing the grease composition, the content is desirably small.

A grease composition containing a metal atom-containing compound is insufficient in the effect of suppressing dust generation, and is difficult to apply to a portion to be lubricated of an apparatus used in a clean environment. In addition, in the case where the grease composition is scattered, a malfunction is easily caused due to attachment of metal atoms derived from the metal atom-containing compound included in the grease composition to a precision electronic apparatus manufactured from the apparatus, thereby greatly affecting the product yield.

From the aforementioned viewpoint, the content of the metal atom-containing compound in the grease composition of an embodiment of the present invention is preferably less than 5% by mass, more preferably less than 2% by mass, still more preferably less than 1% by mass, yet still more preferably less than 0.1% by mass, even yet still more preferably less than 0.01% by mass, and further more preferably less than 0.001% by mass based on the total amount (100% by mass) of the grease composition.

In the present invention, the "content of a metal atom containing compound" means a value as measured in conformity with ASTM D4951.

Examples of the metal atom that is included in the metal atom-containing compound include an alkali metal atom such as lithium atom and sodium atom, an alkaline earth metal atom such as calcium atom and magnesium atom, and a transition metal atom such as zinc and molybdenum.

Examples of the metal atom-containing compound include a metal-based complex soap such as a metal-based soap or a lithium complex soap, in which carboxylic acid or an ester thereof is saponified with a hydroxide of an alkali metal, an alkaline earth metal, or aluminum, which is blended as a thickening agent, and a metal salt or a metal oxide, which is blended as a metal-based dispersant, a metal-based detergent, a metal-based extreme pressure agent, or a metal-based rust inhibitor.

Furthermore, with respect to an embodiment of the present invention, from a viewpoint of providing a low-dusting grease composition and from a viewpoint of improving the yield of a product manufactured from a semiconductor device manufacturing apparatus when the grease composition is used for the portions to be lubricated such as bearings, sliding portions, and joint portions of the manufacturing apparatus or the like, when a halogen-based compound is used in preparing the grease composition, the content is desired to be small. The content of, particularly, a fluorene-based compound among the halogen-based compounds is more desired to be small.

From the aforementioned viewpoint, the content of the halogen-based compound in the grease composition of an embodiment of the present invention is preferably less than 5% by mass, more preferably less than 2% by mass, still more preferably less than 1% by mass, yet still more preferably less than 0.1% by mass, even yet still more preferably less than 0.01% by mass, and further more preferably less than 0.001% by mass based on the total amount (100% by mass) of the grease composition.

Further, from the aforementioned viewpoint, the content of the fluorine-based compound in the grease composition of an embodiment of the present invention is preferably less than 5% by mass, more preferably less than 2% by mass, still more preferably less than 1% by mass, yet still more preferably less than 0.1% by mass, even yet still more preferably less than 0.01% by mass, and further more preferably less than 0.001% by mass based on the total amount (100% by mass) of the grease composition.

In the present invention, the halogen-based compound refers to a compound containing a halogen atom (fluorine atom, chlorine atom, bromine atom, or iodine atom).

Specific examples of the halogen-based compound include perfluoropolyether (PEPE) that is blended as a base oil, polytetrafluoroethylene (PTFE) that is blended as a thickening agent, and a fluorinated silicone-based compound that is blended as an anti-foaming agent.

Hereinafter, the respective components that are blended in the grease composition of the present invention are described.

<Base Oil (A)>

The grease composition of the present invention includes a base oil (A) containing an alkyl naphthalene (A1).

With respect to an embodiment of the present invention, the content of the alkyl naphthalene (A1) in the base oil (A) is preferably 50 to 100% by mass, more preferably 60 to 100% by mass, still more preferably 70 to 100% by mass, yet still more preferably 80 to 100% by mass, even yet still more preferably 90 to 100% by mass, and most preferably 95 to 100% by mass based on the total amount (100% by mass) of the base oil (A).

In addition, in an embodiment of the present invention, the content of the alkyl naphthalene (A1) in the grease composition is preferably 50 to 80% by mass, more preferably 55 to 80% by mass, still more preferably 60 to 80% by mass, yet still more preferably 65 to 80% by mass, and even yet still more preferably 70 to 80% by mass based on the total amount (100% by mass) of the grease composition.

The alkyl naphthalene (A1) used in the present invention is a compound in which at least one hydrogen atom of a naphthalene ring is substituted with an alkyl group.

A carbon number of the alkyl group is preferably 2 to 36, more preferably 4 to 24, and still more preferably 12 to 20. When the alkyl naphthalene has a plurality of alkyl groups, the carbon number of the alkyl group is a total sum of carbon numbers of the respective alkyl groups.

The alkyl group may be either linear or branched.

Furthermore, when the alkyl naphthalene has a plurality of alkyl groups, the respective alkyl groups may be the same or different.

Specific example of the alkyl naphthalene (A1) used in the present invention include a monoalkyl naphthalene, a dialkyl naphthalene, and a trialkyl naphthalene, and include a dialkylnaphthalen and a trialkylnaphthalen, which are alkyl naphthalenes in which two or more hydrogen atoms of the naphthalene ring are substituted with an alkyl group. These alkyl naphthalenes (A1) may be used either alone or in combination of two or more thereof.

A kinematic viscosity at 40° C. of the alkyl naphthalene (A1) that is included in the grease composition of the present invention is preferably 20 to 30 $mm^2/s$, more preferably 22 to 30 $mm^2/s$, still more preferably 24 to 30 $mm^2/s$, and yet still more preferably 26 to 30 $mm^2/s$.

In the present invention, the kinematic viscosity at 40° C. of the alkyl naphthalene (A1) means a value as measured in conformity with JIS K2283.

A viscosity index of the alkyl naphthalene (A1) that is included in the grease composition of the present invention is preferably 50 to 120, more preferably 60 to 110, still more preferably 70 to 100, yet still more preferably 70 to 90, and even yet still more preferably 70 to 80.

In the present invention, the viscosity index of the alkyl naphthalene (A1) means a value as measured and calculated in conformity with JIS K2283.

The base oil (A) that is used in the grease composition of the present invention may contain other base oils other than the alkyl naphthalene (A1) as long as the effects of the present invention are not impaired.

However, with respect to the grease composition of an embodiment of the present invention, there is a concern in that a mineral oil and a poly-α-olefin (PAO) lower the low dust generation property of the grease composition of the present invention, and therefore, they are desirably used in a small amount.

A content of the mineral oil is preferably less than 10 parts by mass, more preferably less than 5 parts by mass, still more preferably less than 1 part by mass, yet still more preferably less than 0.1 parts by mass, and even yet still more preferably less than 0.01 parts by mass based on 100 parts by mass of the alkyl naphthalene (A1), and even more preferably, the mineral oil is not contained.

A content of the poly-α-olefin is preferably less than 10 parts by mass, more preferably less than 5 parts by mass, still more preferably less than 1 part by mass, yet still more preferably less than 0.1 parts by mass, and even yet still more preferably less than 0.01 parts by mass based on 100 parts by mass of the alkyl naphthalene (A1), and even more preferably, the poly-α-olefin is not contained.

Further, in the base oil (A) that is used in an embodiment of the present invention, a total content of the mineral oil and the poly-α-olefin is preferably less than 10 parts by mass, more preferably less than 5 parts by mass, still more preferably less than 1 part by mass, yet still more preferably less than 0.1 parts by mass, and even yet still more preferably less than 0.01 parts by mass based on 100 parts by mass of the alkyl naphthalene (A1).

Here, in the base oil (A) that is used in an embodiment of the present invention, from a viewpoint of providing a low-dusting grease composition, it is desirable that the content of the ester-based oil and the ether-based oil is small.

From the aforementioned viewpoint, a content of the ester-based oil and the ether-based oil in the base oil (A) that is used in an embodiment of the present invention is preferably less than 5% by mass, more preferably less than 2% by mass, still more preferably less than 1% by mass, yet still more preferably less than 0.1 parts by mass, even yet still more preferably less than 0.01 parts by mass, and further more preferably less than 0.001% by mass based on the total amount (100% by mass) of the base oil (A), and even more preferably, the ester-based oil and the ether-based oil are not contained.

With respect to the grease composition of an embodiment of the present invention, a kinematic viscosity at 40° C. of the base oil (A) is preferably 20 to 30 $mm^2/s$, more preferably 22 to 30 $mm^2/s$, still more preferably 24 to 30 $mm^2/s$, and yet still more preferably 26 to 30 $mm^2/s$.

By adjusting the kinematic viscosity at 40° C. of the base oil (A) to the aforementioned range, a phenomenon in which the grease composition causes oil separation may be inhibited. In addition, the grease composition is readily supplied to portions to be lubricated such as bearings, sliding portions, and joint portions of the apparatus, and the occurrence of seizure of a member of the portion to be lubricated may also be inhibited.

In the present invention, the kinematic viscosity at 40° C. of the base oil (A) means a value as measured in conformity with JIS K2283.

With respect to the grease composition of an embodiment of the present invention, the content of the base oil (A) is preferably 50 to 80% by mass, more preferably 55 to 80% by mass, still more preferably 60 to 80% by mass, yet still more preferably 65 to 80% by mass, and even yet still more preferably 70 to 80% by mass based on the total amount (100% by mass) of the grease composition.

<Aliphatic Diurea (B)>

The grease composition of the present invention contains an aliphatic diurea (B) represented by general formula (b1).

$$R^1—NHCONH—R^3—NHCONH—R^2 \quad (b1)$$

In general formula (b1), $R^1$ and $R^2$ each independently represent a monovalent aliphatic hydrocarbon group having 9 to 20 carbon atoms, and $R^1$ and $R^2$ may be the same or different. $R^3$ represents a divalent aromatic hydrocarbon group having 6 to 18 carbon atoms.

A carbon number of the monovalent aliphatic hydrocarbon group that may be selected as $R^1$ and $R^2$ in general formula (b1) is 9 to 20, but is preferably 10 to 20, more preferably 12 to 20, still more preferably 14 to 20, and yet still more preferably 16 to 20 from a viewpoint of obtaining a grease composition having a better low dust generation property.

Here, when the carbon number of the monovalent aliphatic hydrocarbon group is 8 or less, the low dust generation property of the grease composition is insufficient.

Furthermore, when the carbon number of the monovalent aliphatic hydrocarbon group is 21 or more, it is difficult to synthesize the aliphatic diurea (B).

The monovalent aliphatic hydrocarbon group that may be selected as $R^1$ and $R^2$ may be either a saturated aliphatic hydrocarbon group or an unsaturated aliphatic hydrocarbon group, but from a viewpoint of obtaining a grease composition having a better low dust generation property, the monovalent aliphatic hydrocarbon group is preferably a saturated aliphatic hydrocarbon group.

Examples of the monovalent saturated aliphatic hydrocarbon group include an alkyl group having 9 to 20 carbon atoms. Specific examples thereof include a nonyl group, a decyl group, an undecyl group, a dodecyl group, a tridecyl group, a tetradecyl group, a pentadecyl group, a hexadecyl group, a heptadecyl group, an octadecyl group, a nonadecyl group, or an eicosyl group, preferred examples thereof include a heptadecyl group, an octadecyl group, or a nonadecyl group, and more preferred examples thereof include an octadecyl group.

Examples of the monovalent unsaturated aliphatic hydrocarbon group include an alkenyl group having 9 to 20 carbon atoms. Specific examples thereof include a nonenyl group, a decenyl group, an undecenyl group, a dodecencyl group, a tridecenyl group, a tetradecenyl group, a pentadecenyl group, a hexadecenyl group, a heptadecenyl group, an octadecenyl group, a nonadecenyl group or an eicosenyl group, preferred examples thereof include a heptadecenyl group, an octadecenyl group, or a nonadecenyl group, and more preferred examples thereof include an octadecenyl group.

The monovalent saturated aliphatic hydrocarbon group and the monovalent unsaturated aliphatic hydrocarbon group may be either linear or branched, but from the viewpoint of obtaining a grease composition having a better low dust generation property, the monovalent saturated aliphatic hydrocarbon group and the monovalent unsaturated aliphatic hydrocarbon group are preferably linear.

A carbon number of the divalent aliphatic hydrocarbon group that may be selected as $R^3$ in general formula (b1) is 6 to 18, but preferably 6 to 15, and more preferably 6 to 13. When the carbon number of $R^3$ is less than 6 or more than 18, it is difficult to synthesize the aliphatic diurea (B).

Examples of the divalent aromatic hydrocarbon group that may be selected as $R^3$ include a phenylene group, a diphenylmethylene group, a diphenylethylene group, a diphenylpropylene group, a methylphenylene group, a dimethylphenylene group, or an ethylphenylene group.

Among them, a phenylene group, a diphenylmethylene group, a diphenylethylene group, or a diphenylpropylene group is preferred, and a diphenylmethylene group is more preferred.

The aliphatic diurea (B) represented by general formula (b1) may be typically obtained by reacting a diisocyanate with a monoamine. For the reaction, a method of, while heating and stirring a base oil including diisocyanate obtained by blending diisocyanate in the base oil (A) containing the above-described alkyl naphthalene (A1) and heating the blend for dissolution, adding a base oil in which monoamine is dissolved in the base oil (A) containing the alkyl naphthalene (A1) thereto is preferred.

For example, when the compound represented by general formula (b1) is synthesized, a desired diurea compound may be synthesized by the aforementioned method using, as the diisocyanate, a diisocyanate having a group corresponding to the divalent aromatic hydrocarbon group represented by $R^3$ in general formula (b1) and using, as the monoamine, an amine having a group corresponding to the monovalent hydrocarbon group represented by $R^1$ and $R^2$.

With respect to the grease composition of the present invention, a content of the aliphatic diurea (B) is 20 to 30% by mass, but preferably 22 to 28% by mass based on the total amount (100% by mass) of the grease composition.

When the content of the aliphatic diurea (B) is 20% by mass or more, it is easy to make the grease composition excellent in the low dust generation property.

Further, when the content of the aliphatic diurea (B) is 20% by mass to 30% by mass, the grease composition is easily adjusted to an appropriate worked penetration.

The worked penetration of the grease composition may be adjusted to 220 or more by adjusting the kinematic viscosity at 40° C. of the base oil (A) to the aforementioned range and adjusting the content of the aliphatic diurea (B) to the aforementioned range.

<General-Purpose Additive>

The grease composition of an embodiment of the present invention may contain, besides Components (A) and (B), a general-purpose additive which is blended in a general grease composition, as long as the effects of the present invention are not impaired.

Examples of the general-purpose additive include an antioxidant, a rust inhibitor, an extreme pressure agent, a thickening agent, a solid lubricant, a detergent dispersant, a corrosion inhibitor, and a metal deactivator.

These general-purpose additives may be used either alone or in combination of two or more thereof.

Examples of the antioxidant include an amine-based antioxidant such as alkylated diphenylamine, phenyl-α-naphthylamine, and alkylated-α-naphthylamine; and a phenol-based antioxidant such as 2,6-di-t-butyl-4-methylphenol and 4,4'-methylenebis(2,6-di-t-butylphenol).

Examples of the rust inhibitor include a sorbitan fatty acid ester and an amine compound.

Examples of the extreme pressure agent include a phosphorus-based compound.

Examples of the thickening agent include a polymethacrylate (PMA), an olefin copolymer (OCP), a polyalkylstyrene (PAS), and a styrene-diene copolymer (SCP).

Examples of the solid lubricant include polyimide and melamine cyanurate (MCA).

Examples of the detergent dispersant include an ash-free dispersant such as succinimide and a boron-based succinimide.

Examples of the corrosion inhibitor include a benzotriazole-based compound and a thiazole-based compound.

Examples of the metal deactivator include a benzotriazole-based compound.

As described above, with respect to the grease composition of one embodiment of the present invention, when a metal atom-containing compound or a halogen-based compound is used in preparing the grease composition, the content is desirably small.

Therefore, also with respect to the general-purpose additive to be blended in the grease of an embodiment of the present invention, a general-purpose additive being small with respect to the contents of a metal atom and a halogen atom is preferably used, and a general-purpose additive that does not contain a metal atom and a halogen atom is more preferably used.

With respect to the grease of an embodiment of the present invention, the content of each of the general-purpose additives is typically 0 to 10% by mass, preferably 0 to 7% by mass, more preferably 0 to 5% by mass, and still more preferably 0 to 2% by mass based on the total amount (100% by mass) of the grease.

<Physical Properties of Grease Composition of the Present Invention>

With respect to the grease composition of an embodiment of the present invention, the worked penetration at 25° C. thereof is more than 250.

In the present invention, the worked penetration of the grease composition is a value as measured in conformity with JIS K2220 7: 2013.

With respect to the grease composition of the present invention, the kinematic viscosity at 40° C. of the base oil (A) is 20 to 30 $mm^2/s$, and the content of the aliphatic diurea (B) represented by general formula (b1) is 20 to 30% by mass based on the total amount (100% by mass) of the grease composition, so that the worked penetration at 25° C. of the grease composition is adjusted to 220 or more, preferably 250 or more.

With respect to the grease composition of the present invention, the upper limit of the worked penetration at 25° C. is preferably, for example, 340 which is the upper limit of No. 1 in the viscosity classification of JIS K 2220, and more preferably 295 which is the upper limit of No. 2.

<Use of Grease Composition of the Present Invention>

The grease composition of the present invention has an excellent low dust generation property at a level applicable to the portions to be lubricated such as bearings, sliding portions, and joint portions of an apparatus that is installed in a clean environment where dust generation is extremely low, such as a clean room.

Therefore, it is preferred that the grease composition of the present invention is preferably used in an apparatus (for example, a semiconductor manufacturing apparatus, a liquid crystal manufacturing apparatus, a printed circuit board manufacturing apparatus, and the like) that is manufactured or used in a clean room, and more specifically, the grease composition of the present invention is more preferably used for lubricating the portions to be lubricated such as bearings, sliding portions, and joint portions of the apparatus.

That is, the present invention also provides a lubrication method using the above-described grease composition of the present invention for the portions to be lubricated of an apparatus that is manufactured or used in a clean room.

In addition, in order to prevent foreign matters from being incorporated into products, the grease composition of the present invention is not limited to an application to a clean room, and is also suitable for lubricating the portions to be lubricated such as bearings, sliding portions, and joint portions of an apparatus that is used in a food production factory, a pharmaceutical manufacturing factory, and the like.

<Method for Producing Grease Composition of the Present Invention>

Examples of a method for producing the grease composition of the present invention include a preparation method at least including the following step (1).

Step (1): a step of blending the aliphatic diurea (B) represented by general formula (b1) in a base oil (A) containing an alkyl naphthalene (A1) such that the content of the aliphatic diurea (B) is 20 to 30% by mass based on the total amount of the grease composition.

In the step (1), the aliphatic diurea (B) may be blended in the base oil (A) in a state of being dissolved in the base oil (A).

The base oil (A) may be a base oil used in the synthesis of the aliphatic diurea (B), but it is preferred that a part of the base oil (A) is used for the synthesis of the aliphatic diurea (B), and a base oil (A) including the aliphatic diurea (B) is prepared, and then mixed with the remaining base oil (A).

The temperature of the base oil (A) in the step (1) is preferably 100 to 200° C.

Further, in the step (1), a general-purpose additive other than the above-described component (B) may be blended.

EXAMPLES

Next, the present invention is described in more detail by reference to the Examples, but it should be construed that the present invention is by no means limited to these Examples.

The kinematic viscosity at 40° C. and the viscosity index of the base oil used in the Examples were measured and calculated in conformity with JIS K2283.

Example 1

As the base oil (A-1), an alkyl naphthalene having a kinematic viscosity at 40° C. of 28 $mm^2/s$ and a viscosity index of 78 was used.

Into a reaction kettle of a 1-L metal vessel, 350.0 g of the alkyl naphthalene and 81.3 g (325 mmol) of diphenylmethane-4,4'-diisocyanate (MDI) which is a raw material for a thickening agent were added and heated for dissolution to prepare an alkyl naphthalene oil containing MDI. Further, 350 g of the alkyl naphthalene and 168.7 g (632 mmol) of stearylamine were added into a 1-L metal vessel prepared separately, and heated for dissolution, thus separately preparing an alkyl naphthalene oil including stearylamine.

Then, the above-described alkyl naphthalene containing stearylamine was added into a reaction kettle including the alkyl naphthalene oil containing MDI under heating, and the resulting mixture was stirred and homogenized. In addition, 50.0 g of the alkyl naphthalene oil was added to the metal vessel including the alkyl naphthalene containing stearylamine, the resulting mixture was sufficiently stirred, the alkyl naphthalene oil containing stearylamine remaining in the metal vessel was added into the reaction kettle, and then the reaction solution was stirred in the reaction kettle.

Then, the reaction was completed by warming the reaction solution to 90° C. or more and maintaining the temperature for 1 hour, and thus, an aliphatic diurea (B-1) was synthesized.

The aliphatic diurea (B-1) corresponds to an aliphatic diurea in which $R^1$ and $R^2$ in general formula (b1) are a stearyl group (octadecyl group) and $R^3$ is a diphenylmethylene group.

Then, the reaction solution including the aliphatic diurea (B-1) was cooled to room temperature (25° C.) and then subjected to a finish treatment with a triple roll mill, to obtain a grease composition (1).

The content of the aliphatic diurea (B-1) was 25% by mass based on the total amount (100% by mass) of the grease composition (1).

Comparative Example 11

Into a reaction kettle of a 1-L metal vessel, 400.0 g of the alkyl naphthalene and 100.7 g (403 mmol) of diphenylmethane-4,4'-diisocyanate (MDI) which is a raw material for a thickening agent were added and heated for dissolution to prepare an alkyl naphthalene oil containing MDI. Further, 350 g of the alkyl naphthalene and 99.3 g (782 mmol) of octylamine were added into a 1-L metal vessel prepared separately, and heated for dissolution, thus separately preparing an alkyl naphthalene oil including stearylamine.

Then, a grease composition (2) was obtained in the same manner as in Example 1.

The aliphatic diurea (B-2) that is included in the grease composition (2) corresponds to an aliphatic diurea in which $R^1$ and $R^2$ in general formula (b1) are an octyl group and $R^3$ is a diphenylmethylene group.

In addition, the content of the aliphatic diurea (B-2) was 20% by mass based on the total amount (100% by mass) of the grease composition (2).

Comparative Example 2

A grease composition (3) was prepared in the same manner as in Example 1 except that a mixed synthetic oil in which 44% by mass of a poly-α-olefin was blended together with blending 29% by mass of pentaerythritol carboxylate was used, and the content of the aliphatic diurea (B-1) was adjusted to 27% by mass.

The kinematic viscosity at 40° C. of the mixed synthetic oil used in Comparative Example 2 was 100 $mm^2/s$.

L) counted by a 50-hour LM guide dust generation test when each grease composition was used.

It can be said that the smaller the value of the average number of dust particles generated is, the lower dust generation property the grease composition has. Further, based on the value of the average number of dust particles generated, the dusting property of the grease composition in the LM guide dust generation test by the following criteria was also evaluated.

(Evaluation Criteria for Dusting Property of Grease Composition in LM Guide Dust Generation Test)

A: The average number of dust particles generated is less than 40 particles/L.

B: The average number of dust particles generated is 40 particles/L or more and less than 50 particles/L.

C: The average number of dust particles generated is 50 particles/L or more.

TABLE 1

| | | Example 1 | Comparative Example 1 | Comparative Example 2 |
|---|---|---|---|---|
| Type of grease | | Grease composition (1) | Grease composition (2) | Grease composition (3) |
| Composition of grease | Base oil (A) Base oil (A-1) | 75% by mass | 80% by mass | |
| | Pentaerythritol carboxylate | | | 29% by mass |
| | Poly-α-olefin | | | 44% by mass |
| | Aliphatic diurea (B-1) | 25% by mass | | 27% by mass |
| | Aliphatic diurea (B-2) | | 20% by mass | |
| Kinetic viscosity at 40° C. of base oil (A) ($mm^2/s$) | | 28 | 28 | 100 |
| Worked penetration of grease | | 253 | 242 | 280 |
| LM guide dust generation test | Average number of dust particles generated (particles/L) | 34 | 48 | 53 |
| | Evaluation | A | B | C |

The grease compositions (1) to (3) in Example 1 and Comparative Examples 1 and 2 were subjected to measurement and test in the following (i) and (ii). The results are shown in Table 1.

In Table 1, the contents of the base oil (A) and the aliphatic diurea (B) are contents based on the total amount of the grease composition.

(i) Measurement of Worked Penetration of Grease Composition

Measured in conformity with JIS K 2220.7.

(ii) LM Guide Dust Generation Test

In an acrylic case in a clean booth having an air cleanliness equivalent to "ISO class 2" defined in ISO 14644-1 Part 1, a ball retainer-type linear motion (LM) guide was reciprocated, generated dust was sucked into a particle counter at a flow rate of 2.83 L/min, and the number of dust particles having a particle diameter of 0.1 μm or more generated was counted.

As a more specific present test method, the guide was disassembled into rails, blocks, retainers, and balls and cleaned, 1.5 g of the grease composition as a sample was applied to the assembled block, the assembled block was attached to the rail, and under conditions of a speed of 1,000 mm/s and a stroke of 200 mm, after the value of the number of dust particles generated to be counted was stabilized, the guide was reciprocated for 50 hours.

Table 1 shows an average of the number of dust particles having a particle diameter of 0.1 μm or more (unit: particles/

In Table 1, the followings can be seen.

In Example 1, it can be seen that the grease composition (1) has an excellent low dust generation property.

In this regard, it can be seen that in Comparative Example 1, when $R^1$ and $R^2$ in general formula (b1) are an octyl group (8 carbon atoms) as in the aliphatic diurea (B-2), the amount of dust particles generated is increased even though the worked penetration is the same as that in the grease composition (1) in Example 1.

Further, it can be seen that even though the same aliphatic diurea (B) as in Example 1 is used in Comparative Example 2, the amount of dust particles generated is increased when the base oil is changed from the alkyl naphthalene to a mixed synthetic oil of a fatty acid ester and a poly-α-olefin.

From the results, it has become apparent that a grease composition containing, together with a base oil (A) containing an alkyl naphthalene (A1), 20 to 30% by mass of the aliphatic diurea (B) represented by general formula (b1), has an excellent low dust generation property.

The invention claimed is:

1. A lubrication method, comprising:

applying a grease composition to parts of an apparatus that is manufactured or used in a clean room to lubricate the parts; wherein the grease composition comprises a base oil (A) containing an alkyl naphthalene (A1), and an aliphatic diurea (B) represented by formula (b1):

$$R^1\text{—NHCONH—}R^3\text{—NHCONH—}^2 \quad \text{(b1)}$$

wherein, $R^1$ and $R^2$ each independently represent a monovalent aliphatic hydrocarbon group having 9 to 20 carbon atoms, and R represents a divalent aromatic hydrocarbon group having 6 to 18 carbon atoms, wherein a content of the aliphatic diurea (B) is from 22% to 30% by mass based on a total amount of the grease composition;

wherein a worked penetration of the grease composition at 25° C. is 250 or more;

wherein a kinematic viscosity at 40° C. of the base oil (A) is from 20 to 30 $mm^2/s$;

wherein a content of the alkyl naphthalene (A1) in the grease composition is from 70 to 100% by mass based on a total amount of the base oil (A);

wherein the part of the apparatus is selected from portions to be lubricated of the group consisting of bearings, sliding portions and joint portions of a semiconductor manufacturing apparatus, a liquid crystal manufacturing apparatus or a printed circuit board manufacturing apparatus.

2. The lubrication method according to claim 1, wherein the grease composition further comprises a poly-α-olefin in an amount of less than 10 parts by mass based on 100 parts by mass of the alkyl naphthalene (A1).

3. The lubrication method according to claim 1, wherein the grease composition further comprises a mineral oil in an amount of less than 10 parts by mass based on 100 parts by mass of the alkyl naphthalene (A1).

4. The lubrication method according to claim 1, wherein the grease composition further comprises a metal atom-containing compound in an amount of less than 5% by mass based on a total amount of the grease composition.

5. The lubrication method according to claim 1, wherein an average of the dust particles as particles/L having a particle diameter of 0.1 μm or more counted by a 50-hour LM guide dust generation test for the grease composition is less than 40 particles/L.

6. The lubrication method according to claim 1, wherein the worked penetration of the grease composition at 25° C. is 340 or less.

* * * * *